United States Patent [19]

Kirk

[11] 4,013,267

[45] Mar. 22, 1977

[54] PENDULUM JACK

[76] Inventor: Norman W. Kirk, 9 Rosedale Ave., Montclair, N.J. 07042

[22] Filed: June 1, 1976

[21] Appl. No.: 691,425

[52] U.S. Cl. ..... 254/85; 254/97; 254/101; 254/DIG. 1

[51] Int. Cl.[2] ..... B66F 3/08

[58] Field of Search ..... 254/84, 85, 94, 95, 254/97, 98, 100, 101, 103, DIG. 1, 1

[56] References Cited

UNITED STATES PATENTS

| | | | |
|---|---|---|---|
| 1,709,506 | 4/1929 | Wallace et al. | 254/101 |
| 1,916,497 | 7/1933 | Skoy | 254/101 |
| 2,819,873 | 1/1958 | Pearne | 254/1 |
| 3,240,471 | 3/1966 | Townsend | 254/99 |

FOREIGN PATENTS OR APPLICATIONS

| | | | |
|---|---|---|---|
| 271,988 | 3/1914 | Germany | 254/101 |

*Primary Examiner*—Al Lawrence Smith
*Assistant Examiner*—Robert C. Watson

[57] ABSTRACT

An automobile jack having a pivotal center post mounted in a swivel base and a pair of opposed legs which enables the user to move the car after it has been raised by the jack. The legs are caused to translate together in opposing directions by means of a crank and gear mechanism to cause the post leg while the car is raised to pivot and thereby shift the car in the desired direction for balancing purposes in order to secure the car in its raised position.

1 Claim, 3 Drawing Figures

PENDULUM JACK

This invention relates to automobile jacks and, in particular, to car jacks having additional legs which cofunction with a swivel base pad.

The prior art reveals jack constructions which include swivel connected base pads and extra legs which are pivoted together. See, for example, U.S. Pat. No. 3,606,254. The present invention comtemplates this type of construction with the legs arranged to translate oppositely through a rack and pinion drive for the purpose of pivoting the center post of the jack to shift the car in raised condition. The direction of shift depends on the relative direction of the opposing leg translation.

One object of the invention is to provide a new and improved pendulum type of automobile jack.

Other objects and advantages of the invention may be appreciated on reading the following description of one embodiment thereof which is taken in conjunction with the accompanying drawings, in which.

Figure 1:
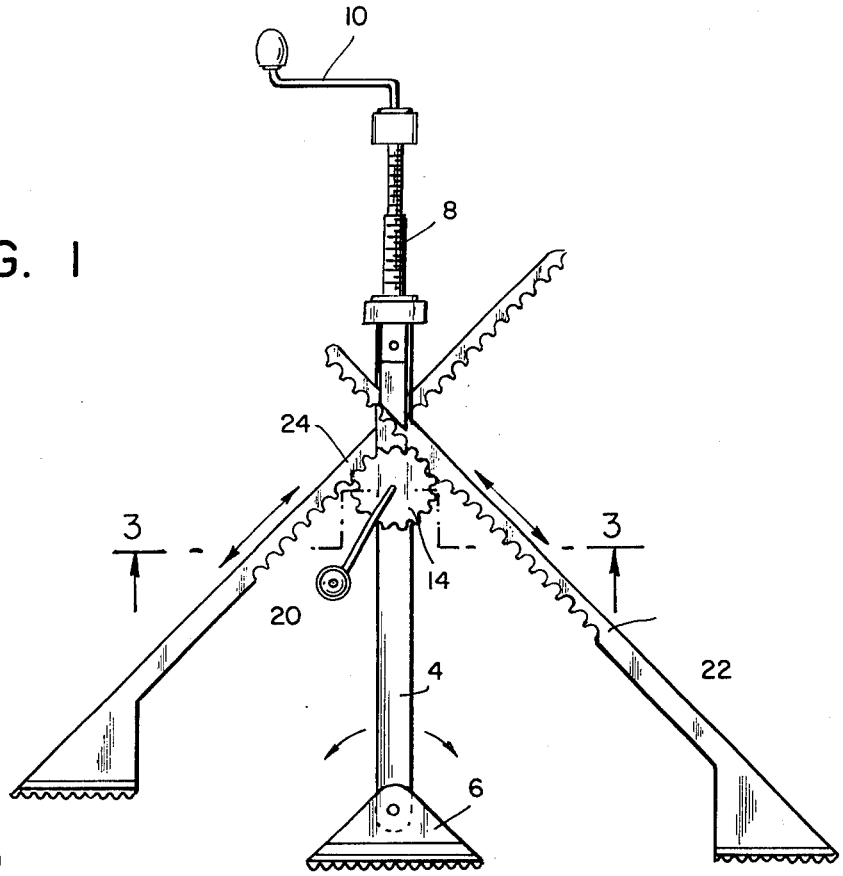
FIG. 1 is a front elevation of the improved pedulum jack.
Figure 2:
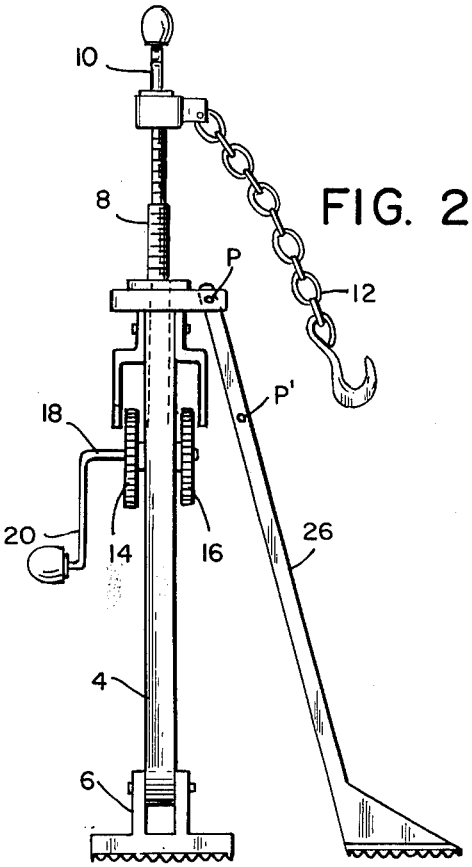
FIG. 2 is a side elevation of the pendulum jack.
Figure 3:
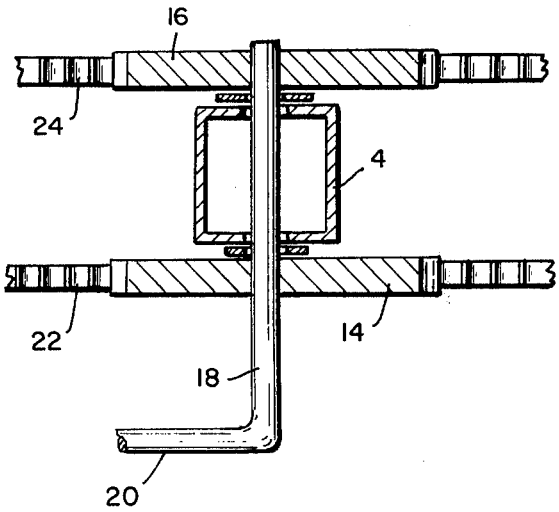
FIG. 3 is an enlarged detail taken on the line 3—3 of FIG. 1.

Referring to the drawings, jack post 4 is pivotally mounted on swivel base 6. Screw lift 8 is adapted to be turned within the post by crank 10 to which chain hook 12 is attached.

Supported on the post 4 are gears 14 and 16 which are mounted on common shaft 18 extending through the post and turned together by handle 20. Engaging the gears 14 and 16 are rack and pinion of leg 22 and leg 24, respectively. Pivot support 26 is pivotally supported at points p or p′ as desired.

In operation the hook is placed under the car bumper and the car is raised by the screw lift 8. Pivot handle 20 is then turned to move in translation the legs oppositely to one another. The car is thereby shifted to one side or the other depending on the rotational direction of the gears.

Various modifications of the invention may be effected by persons skilled in the art without departing from the scope and principle thereof as defined by the appended claims.

What is claimed is:

1. A pendulum jack comprising a central post, a swivel base, said post being pivotally mounted in said base, a screw lift disposed in said post, a chain hook secured to said lift, a pair of gears mounted on a common shaft on opposite sides of said post, a pair of legs having rack teeth engaging said gears, respectively, and adapted to be moved oppositely in translation in a direction depending on the selected angle of pivot for said post.

* * * * *